US005125635A

United States Patent [19]

Iwabuchi

[11] Patent Number: 5,125,635

[45] Date of Patent: Jun. 30, 1992

[54] COLLATION ERROR INDICATION SYSTEM FOR COLLATOR

[75] Inventor: Shigeto Iwabuchi, Kyoto, Japan

[73] Assignee: Horizon International Inc., Shiga, Japan

[21] Appl. No.: 547,960

[22] Filed: Jul. 5, 1990

[30] Foreign Application Priority Data

Sep. 12, 1989 [JP] Japan ..... 1-107088[U]

[51] Int. Cl.[5] ..... B65H 43/02

[52] U.S. Cl. ..... 270/56; 270/54; 271/263

[58] Field of Search ..... 270/54, 52, 56, 58; 271/263

[56] References Cited

U.S. PATENT DOCUMENTS

| | | | |
|---|---|---|---|
| 3,902,708 | 9/1975 | Wise | 270/54 |
| 4,471,954 | 9/1984 | Bourg | 270/58 |
| 4,494,748 | 1/1985 | Miyashita et al. | 271/288 |
| 4,566,681 | 1/1986 | Bottcher et al. | 270/58 |
| 4,936,562 | 6/1990 | Rowe | 270/56 |

FOREIGN PATENT DOCUMENTS

| | | |
|---|---|---|
| 0087487 | 9/1983 | European Pat. Off. . |
| 56-61247 | 5/1981 | Japan . |
| 58-11802 | 3/1983 | Japan . |

*Primary Examiner*—Edward K. Look
*Assistant Examiner*—Therese M. Newholm
*Attorney, Agent, or Firm*—Morgan & Finnegan

[57] ABSTRACT

A collation error indication system for a collator is provided wherein first indication elements for indicating the paper feeding condition of the present collation cycle and second indication elements for indicating the paper feeding condition of at least the immediately before collation cycle are arranged at each paper supply shelf so that the paper feeding conditions of the present collation cycle and the immediately before collation cycle are indicated during each collation cycle. When the abnormal paper feeding occurs, the collation operation is stopped after the collation cycle subsequent to the collation cycle with the abnormal paper feeding has finished. Thus it is easy for the operator to recognize which page should be recollated in the miscollated object, even though a plurality of collation cycles proceed simultaneously.

4 Claims, 3 Drawing Sheets

COLLATION ERROR INDICATION SYSTEM FOR COLLATOR

BACKGROUND OF THE INVENTION

This invention relates to a collation error indication system for a collator.

A conventional type of collator comprises a plurality of paper supply shelves spaced in a vertical direction and each of paper supply shelves supports a stack of paper sheets to be collated thereon. A paper feeding mechanism is arranged at each paper supply shelf and then is driven by a drive mechanism in such a manner that the top sheet in the stack is successively removed from the stack and fed into a paper collating section of the collator. Then during each collation cycle, the paper sheets are successively fed one by one from each paper supply shelf into the paper collating section of the collator.

For the purpose of accomplishing a high speed collating operation, it has been proposed to start the subsequent collation cycle in proceeding the preceding collation cycle, and the collator adapted to start the paper feeding for the subsequent collation cycle during the paper feeding for the preceding collation cycle proceeds has been provided.

On the other hand if the collation error would occur due to abnormal paper feeding such as a double insertion of paper sheets, no insertion of paper sheets and a paper catching in the feed rollers or the collating section, it is necessary to indicate the occurrence of the collation error in order to stop the paper collating operation and remove the miscollated object from the collator. Therefore in the conventional type of collator, a collation error indication system is arranged at each paper supply shelf so as to indicate the occurrence of the paper feed error.

However, in such collation error indication system, when the subsequent collation cycle begins in proceeding the preceding collation cycle, even though the occurrence of the collation error is indicated by the system during the preceding collation cycle, this error information is canceled as long as the collation error does not occur in the collation cycle subsequent to the collation cycle with the abnormal paper feeding.

Then it is necessary for the operator to check over a whole page of the collated object because the information of the paper feed error is not clear.

SUMMARY OF THE INVENTION

Therefore it is the object of the invention to provide a collation error indication system for a collator adapted to indicate at which page the paper feed error occurs in the miscollated object even though a plurality of successive collation cycles proceed simultaneously.

Accordingly, the invention provides a collation error indication system applied to a collator wherein a plurality of paper supply shelves are arranged in a spaced relationship with one another and a stack of paper sheets to be collated is supported on each of said paper supply shelves and wherein a paper feeding mechanism is arranged at each paper supply shelf and driven by a drive mechanism whereby the paper sheets are successively fed one by one from each said paper supply shelf into a collating section during each collation cycle, comprising indication means arranged at each of said paper supply shelves, said indication means including one or more first indication elements for indicating the paper feeding condition of the present collation cycle and one or more second indication elements for indicating the paper feeding condition of at least the immediately before collation cycle; detection means for detecting the paper feeding condition of said each paper supply shelf to produce a paper feed error detection signal when abnormal paper feeding occurs and actuating said first indication elements of said indication means to indicate the paper feeding condition of the present collation cycle; means for transferring the information indicated by said first indication elements of said indication means to said second indication elements whenever the paper feeding for the subsequent collation cycle begins; drive stopping means responsive to said paper feed error detection signal to stop said drive mechanisms from driving said paper feeding mechanisms and only operative after the collation cycle subsequent to the collation cycle with the abnormal paper feeding has finished.

In a preferable embodiment, each of said paper feeding mechanisms further comprises feed roller means disposed between said paper supply shelf and said collating section of said collator and said detection means comprises paper feed sensor means arranged in the neighborhood of said feed roller means for detecting the paper sheet passing through said feed roller means to generate a paper detection signal during the paper sheet is passing through said feed roller means; pulse generator means for generating a series of clock pulses according to the movement of said paper feeding mechanism; counter means for counting the number of said pulses generated by said pulse generator during each collation cycle; comparator means for generating a detection timing signal when said counter means counts more pulses than a predetermined number of pulses; means for detecting the occurrence of abnormal paper feeding according to said paper detection signal and said detection timing signal.

In another embodiment, said means for transferring the information indicated by said first indication elements to said second indication elements whenever the paper feeding for the subsequent collation cycle begins further comprises memory means for storing the operating stat of said first indication elements and transferring the stored value of the operating state of said first indication elements in the preceding collation cycle to said second indication elements whenever the paper feeding operation for the collation cycle begins.

In further embodiment, said drive stopping means comprises a central processing unit.

In further embodiment, said one or more first indication elements and said one or more second indication elements consist of a light-emitting diode, respectively.

In such arrangement, when abnormal paper feeding occurs, the first indication elements indicates the occurrence of the paper feed error, but the collation cycle with such abnormal paper feeding is still continued. Thereafter the collation cycle subsequent to the collation cycle with the abnormal paper feeding is started and simultaneously the information indicated by the first indication elements is transferred to the second indication elements. Then the first indication elements indicate the paper feeding condition of the collation cycle which has been started. And when the collation cycle subsequent to the collation cycle with the abnormal paper feeding has finished, the collating operation is stopped.

Thus the operator can easily recognize at which page the collation error occurs according to the information indicated by the first indication elements.

BRIEF DESCRIPTION OF THE DRAWINGS

The invention will be described in more detail with reference to a preferred embodiment illustrated in the accompanying drawings, in which.

DETAILED DESCRIPTION OF PREFERRED EMBODIMENTS

Figure 3:
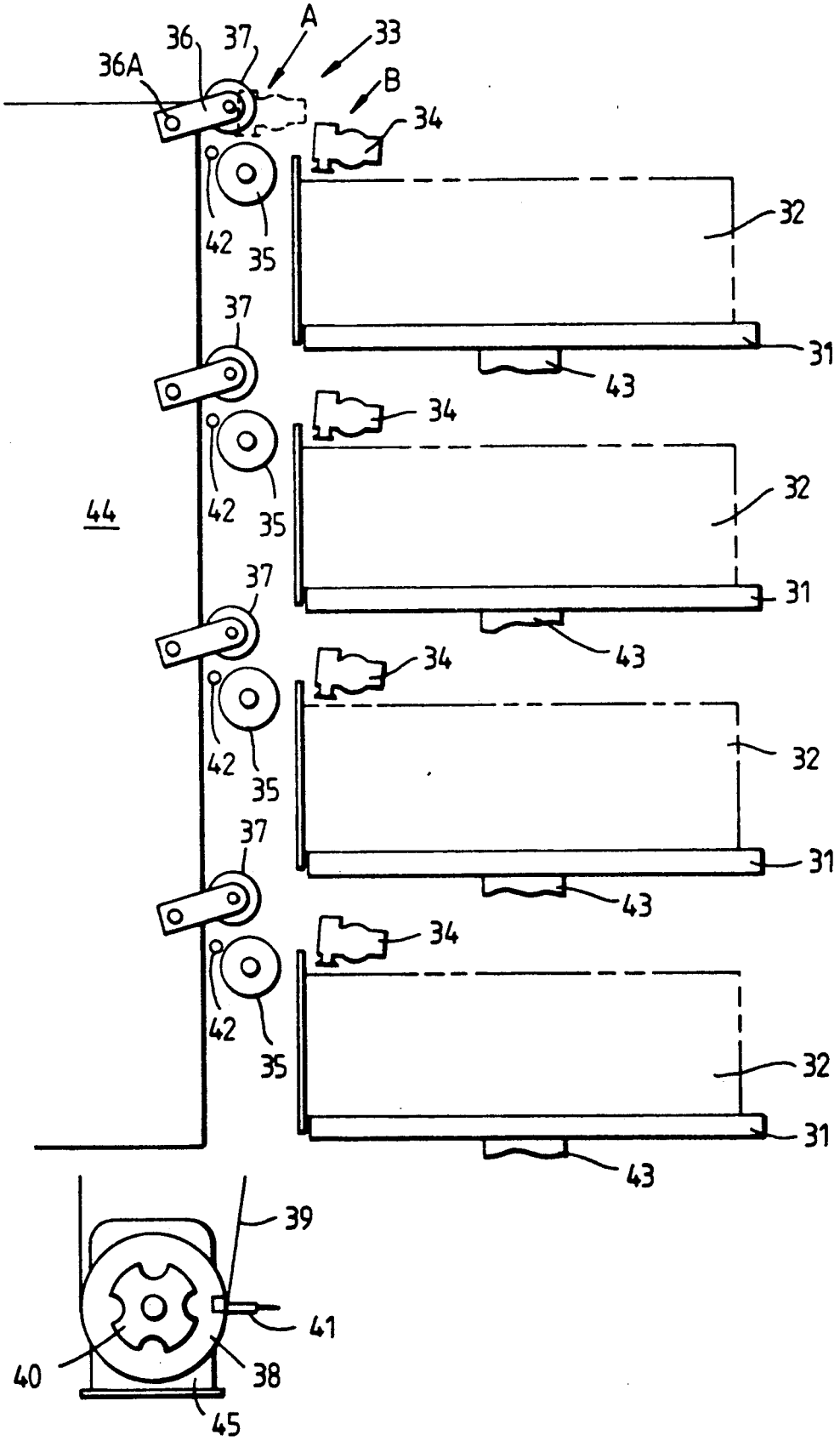
FIG. 3 is a schematic side view of a collator provided with the collation error indication system in FIGS. 1 and 2.

FIG. 3 is a schematic side view of a collator to which a collation error indication system according to the invention is applied.

In FIG. 3, a plurality of paper supply shelves 31 are arranged in parallel spaced relationship with one another and each paper supply shelf 31 is guided for vertical movement by an actuator 43 and a stack of paper sheets 32 to be collated is supported on the paper supply shelf 31 so that the top sheet in the stack 32 is successively removed from the stack 32.

Furthermore, a paper feeding mechanism 33 is arranged at each paper supply shelf 31. The paper feeding mechanism 33 comprises feed rollers disposed at a paper feeding station which is positioned between the paper supply shelf 31 and a collating section 44 of the collator, suction heads 34 movable between a first position (position B in FIG. 3) whereat the suction heads are engageable with the upper surface of the top sheet in the stack 32 so as to remove the top sheet from the stack and a second position (position A in FIG. 3) whereat the suction heads are located close to the feed rollers adapted to transfer the removed paper sheet to the feed rollers. The feed rollers consist of a driving roller 35 located at a fixed position for rotation about its axis and an idle roller 37 supported on one end of an arm 36 whose other end is attached to a horizontally extending pivot 36A and then the arm 36 with the idle roller 37 upwardly and downwardly swing about the pivot 36A.

Each of the paper feeding mechanisms 33 is driven by a drive mechanism which includes a common drive source composed of a motor 45 disposed beneath the lowermost paper supply shelf and a pulley 38 mounted on the drive shaft of the motor 45 and a power transmission device (not shown) arranged at each paper supply shelf for selectively connecting the paper feeding mechanism to the pulley 38 through a drive belt 39. Then each of the paper feeding mechanisms 33 performs a paper feeding operation by receiving a drive force from the motor 45 when it receives a paper feed initiating signal generated each collation cycle. Furthermore the arms 36 are operatively connected to the respective power transmission device so that the idle roller 37 is usually lifted except that it is lowered when the suction heads 34 are positioned at the second position. Thus during each collation cycle, the paper feed initiating signal is successively transmitted from the power transmission device of the drive mechanism of the uppermost paper supply shelf through the power transmission device of the lowermost paper supply shelf with a predetermined time delay. Consequently a sequence of the paper feeding operations which proceeds from the uppermost paper supply shelf through the lowermost paper supply shelf is performed so that the paper sheets are fed one by one from each paper supply shelves into the collator during each collation cycle.

An error indication control will be explained in detail with reference to FIGS. 1 and 2. The numerals 11A~11N designate indication control circuits arranged at each paper supply shelf 31. Each of the circuits 11A~11N comprises a counter 12, a comparator 13, a detector 14, a memory 15, first indication elements 16~18 for indicating the paper feeding condition of the present collation cycle, and second indication elements 19~21 for indicating the paper feeding condition of the immediately before collation cycle. The first and second indication elements 16~21 consist of a light-emitting diode (LED), respectively.

The detector 14 detects the abnormal paper feeding such as a double insertion of paper sheet, no insertion of paper sheet and a paper catching in the feed rollers or the collating section. The first indication elements 16~18 operate responsive to detection of such abnormal paper feeding by the detector 14.

The memory 15 operates to store the operating state of the first indication elements 16~18 when it receives the paper feed initiating signal. Then the second indication elements 19~21 operate responsive to the operating state of the first indication elements 16~18 stored in the memory 15.

The numeral 22 denotes a central processing unit (CPU) and the numeral 23 denotes a drive mechanism for driving the paper feeding mechanism 33, and the numeral 24 denotes a pulse generator for generating a pulse whose frequency is changed according to the speed of the paper feeding. Such pulse generator 24 generally consists of an encoder 41 activated by a rotor 40 which is coaxially attached to the pulley 38.

The collation cycle is started by transmitting the paper feed initiating signal $a_1$ from the CPU 22 to the power transmission device of the drive mechanism 23 arranged at the uppermost paper supply shelf. Then a suction head driving signal $b_1$ is transmitted to the suction head 34 and then a sequence of the paper feeding by the suction head 34 is started.

Referring to FIG. 3 again, a paper feed sensor 42 is disposed just behind the driving roller 35 so as to detect the paper sheet passing through the driving roller 35. A paper passing signal $c_1$ is generated by the paper feed sensor 42 during the paper sheet is passing through the paper feed sensor 42.

The paper feed initiating signal $a_1$ is also transmitted to the counter 12 as a reset signal and then the counter 12 counts the number of pulses from the pulse generator 24 as a clock pulse.

When the counter 12 counts more pulses than the number of the pulse corresponding to time interval required by the detection of one paper sheet, the comparator 13 transmits a detection timing signal $d_1$ to the detector 14.

At that time the detector 14 detects whether a double insertion of paper sheet, no insertion of paper sheet and a paper catching in the feed rollers or the collating section occurs or not. Thus no insertion of paper sheet is detected by the fact that the paper feed sensor 42 does not yet detect the passage of the paper sheet when the detector 14 receives the detection timing signal $d_1$. The paper catching in the feed rollers or the collating section is detected by the fact that the paper feed sensor 42 remains detecting the paper sheet when the detector 14 receives the detection timing signal $d_1$. The double insertion of paper sheet is detected by detecting quantity of light which transmits through the paper sheet by means of the paper feed sensor 42 when the detector 14 receives the detection timing signal $d_1$.

The first indication elements 16~18 are operated to indicate the paper feeding condition by the output signal from the detector 14 according to these detection results.

Figure 1:
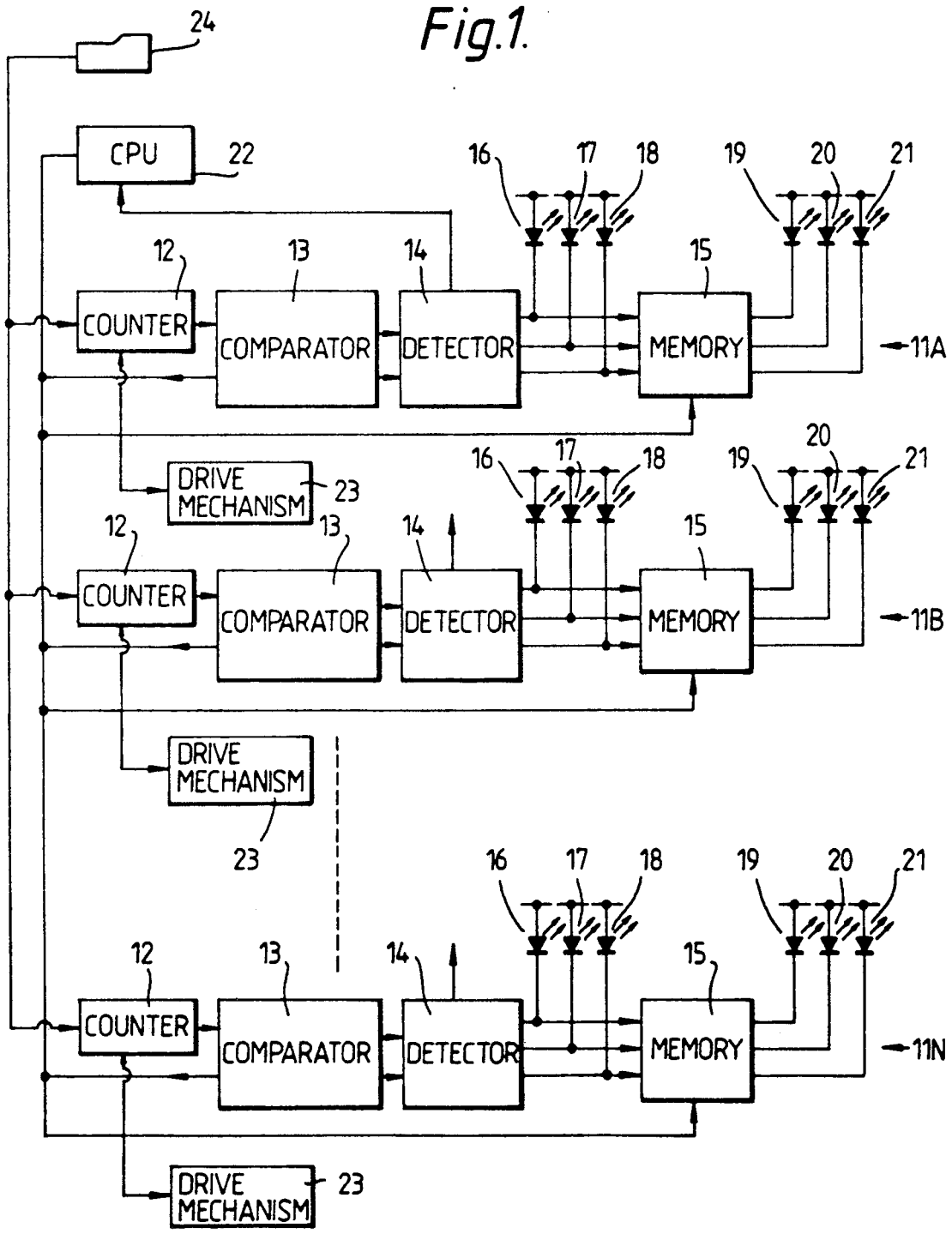
FIG. 1 is a circuit diagram of an embodiment of an collation error indication system for a collator according to the invention.
Figure 2:
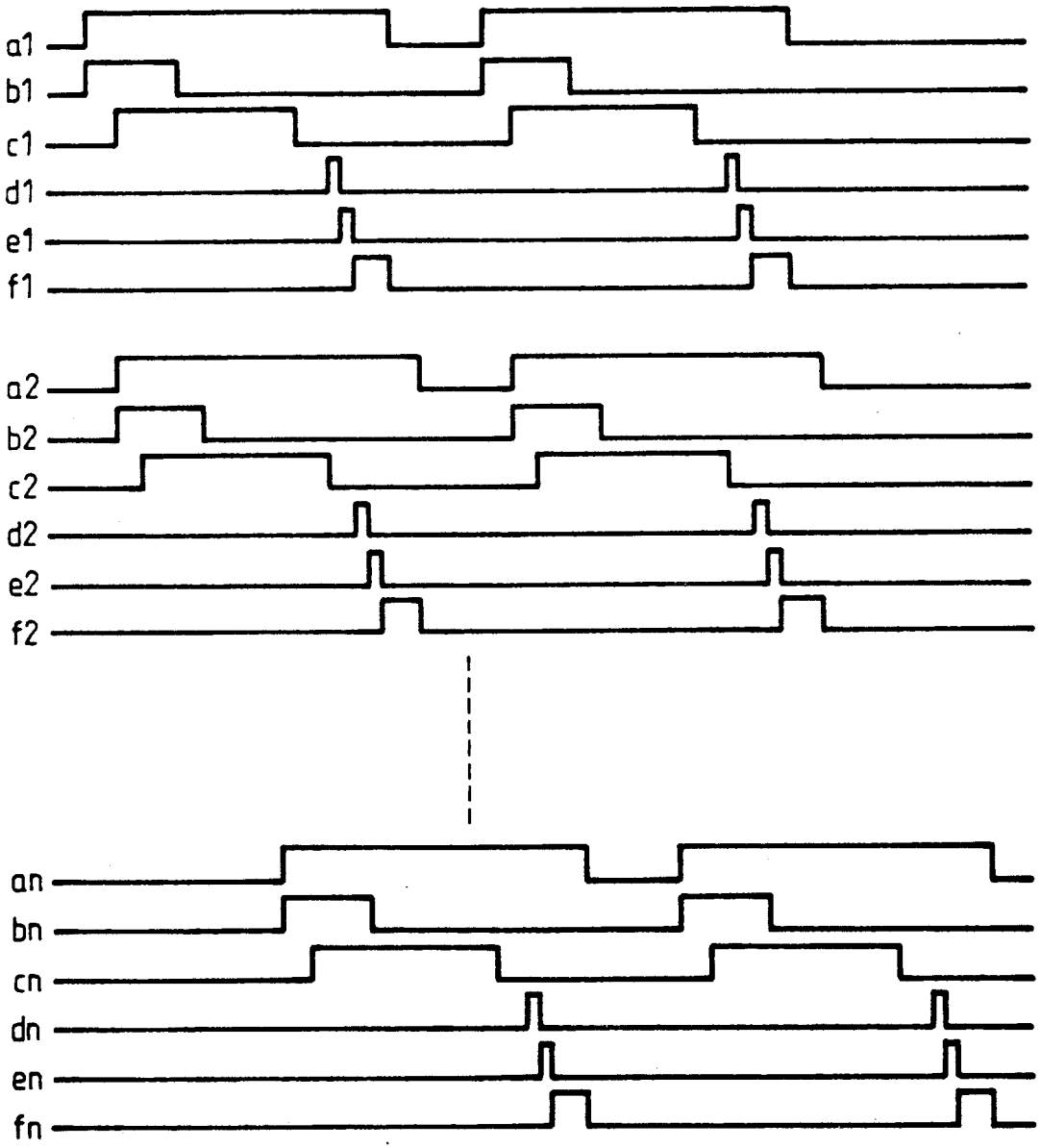
FIG. 2 is a timing chart of the collation error indication system in FIG. 1.

FIG. 2 is a timing chart of the collation error indication system shown in FIG. 1. With reference to FIG. 2, the counter 12 receives the next clock pulse and the comparator 13 transmits a post process timing signal $e_1$ that follows the detection timing signal $d_1$ to the detector 14. The post process timing signal $e_1$ is a timing signal which is used to change the reference value in such a manner that quantity of transmitting light can be used as the reference value for the detection of the double insertion of paper sheet during the paper feeding for the subsequent collation cycle in the case of the double insertion of paper sheet being detected by detecting the quantity of light transmitted through the paper sheet.

The detector 14 is triggered by the post process timing signal $e_1$ to generate a detection ending signal $f_1$. The CPU 22 receives the detection ending signal $f_1$, but it does not generate the paper feed initiating signal $a_1$ yet. Then after a predetermined time-lag, the paper feed initiating signal $a_1$ is generated by the CPU 22 again.

The memory 15 responsive to this signal $a_1$ to store the operating state of the first indication elements 16~18 and then operate the second indication elements 19~21 to indicate the paper feeding condition of the immediately before collation cycle according to such stored operating state. Namely the information indicated by the first indication elements 16~18 is transmitted to the second indication elements 19~21.

And the first indication elements 16~18, which indicate the paper feeding condition of the present collation cycle, indicate the paper feeding condition of the subsequent collation cycle in response to the detection signal from the detector 14.

If the detector 14 detects the abnormal paper feeding during the subsequent collation cycle, it transmits the paper feed error detection signal to the CPU 22. However the CPU does not immediately vanish the paper feed initiating signal because there is a possibility that the paper feeding for the subsequent collation cycle already begins. Thus the CPU 22 locks the generation of the subsequent paper feed initiating signal. Consequently the collation cycle with the abnormal paper feeding has finished and the first indication elements 16~18 indicate the occurrence of the paper feed error and thereafter the drive mechanism 23 stop driving the paper feeding mechanisms 33 after the collation cycle subsequent to the collation cycle with such abnormal paper feeding has finished. At that time it can easily become clear which page should be recollated by means of checking the information indicated by the first and second indication elements 16~21.

In FIG. 2, each set of signals $a_2$~$f_2$, . . . , $a_n$~$f_n$, which corresponds to the set of signals $a_1$~$f_1$, is transmitted to the second level height paper supply shelf, ... , the nth level height, that is, the lowermost paper supply shelf, respectively.

According to the invention described so far in detail, in the arrangement wherein two sets of the indication elements are arranged at each paper supply shelf and wherein the paper feeding conditions of the present collation cycle and the immediately before collation cycle are indicated during each collation cycle, it is easy for the operator to recognize which page should be recollated in the miscollated object, even though a plurality of collation cycles proceed simultaneously.

We claim:

1. A collation error indication system applied to a collator wherein a plurality of paper supply shelves are arranged in a spaced relationship with one another and a stack of paper sheets to be collated is supported on each of said paper supply shelves and wherein a paper feeding mechanism is arranged at each paper supply shelf and driven by a drive mechanism whereby the paper sheets are successively fed one by one from said each paper supply shelf into a collating section during each collation cycle, comprising:

indication means arranged at each of said paper supply shelves, said indication means including one or more first indication elements for indicating the paper feeding condition of the present collation cycle and one or more second indication elements for indicating the paper feeding condition of at least the immediately before collation cycle;

detection means for detecting the paper feeding condition of said each paper supply shelf to produce a paper feed error detection signal when abnormal paper feeding occurs and actuating said first indication elements of said indication means to indicate the paper feeding condition of the present collation cycle;

means for transferring the information indicated by said first indication elements of said indication means to said second indication elements whenever the paper feeding for the subsequent collation cycle begins including memory means for storing the operating state of said first indication elements and transferring said stored operating state of said first indication elements in the preceding collation cycle to said second indication elements whenever the paper feeding operation for the collation cycle begins;

drive stopping means responsive to said paper feed error detection signal to stop said drive mechanisms from driving said paper feeding mechanisms and only operative after the collation cycle subsequent to the collation cycle with the abnormal paper feeding has finished.

2. A collation error indication system for a collator according to claim 1, wherein each of said paper feeding mechanisms further comprises feed roller means disposed between said paper supply shelf and said collating section of said collator and said detection means comprises:

paper feed sensor means arranged in the neighborhood of said feed roller means for detecting the paper sheet passing through said feed roller means to generate a paper detection signal during the paper sheet passing through said feed roller means;

pulse generator means for generating a series of clock pulses according to the movement of said paper feeding mechanism;

counter means for counting the number of said pulses generated by said pulse generator during each collation cycle;

comparator means for generating a detection timing signal when said counter means counts more pulses than a predetermined number of pulses;

means for detecting the occurrence of the abnormal paper feeding according to said paper detection signal and said detection timing signal.

3. A collation error indication system for a collator according to claim 3, wherein said drive stopping means comprises a central processing unit.

4. A collation error indication system for a collator according to any one of the preceding claims, wherein said one or more first indication elements and said one or more second indication elements consist of a light-emitting diode, respectively.

* * * * *